US011553289B2

(12) United States Patent
Fitz et al.

(10) Patent No.: US 11,553,289 B2
(45) **Date of Patent: *Jan. 10, 2023**

(54) USER ADJUSTMENT INTERFACE USING REMOTE COMPUTING RESOURCE

(71) Applicant: Starkey Laboratories, Inc., Eden Prairie, MN (US)

(72) Inventors: Kelly Fitz, Eden Prairie, MN (US); Kirk Klobe, Minnetonka, MN (US); David Haggerty, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/949,948

(22) Filed: Nov. 20, 2020

(65) Prior Publication Data

US 2021/0219077 A1 Jul. 15, 2021

Related U.S. Application Data

(63) Continuation of application No. 16/188,264, filed on Nov. 12, 2018, now Pat. No. 10,848,881, which is a (Continued)

(51) Int. Cl.

| | |
|---|---|
| ***H04R 25/00*** | (2006.01) |
| ***G10L 25/84*** | (2013.01) |
| ***H04R 29/00*** | (2006.01) |

(52) U.S. Cl.

CPC ..... *H04R 25/558* (2013.01); *G10L 25/84* (2013.01); *H04R 25/505* (2013.01); (Continued)

(58) Field of Classification Search

CPC .. H04R 25/505; H04R 25/507; H04R 25/554; H04R 25/558; H04R 25/70; (Continued)

(56) References Cited

U.S. PATENT DOCUMENTS

| | | | | |
|---|---|---|---|---|
| 4,901,353 | A | 2/1990 | Widin | |
| 5,754,661 | A * | 5/1998 | Weinfurtner ..... | H04R 25/507 381/312 |

(Continued)

FOREIGN PATENT DOCUMENTS

| | | | |
|---|---|---|---|
| EP | 1382220 | A2 | 1/2004 |
| WO | WO-2015024586 | A1 | 2/2015 |

OTHER PUBLICATIONS

"U.S. Appl. No. 15/130,020, Non Final Office Action dated Dec. 8, 2017", 10 pgs.

(Continued)

*Primary Examiner* — Huyen D Le

(74) *Attorney, Agent, or Firm* — Schwegman Lundberg & Woessner, P.A.

(57) ABSTRACT

Disclosed herein, among other things, are systems and methods for a user adjustment interface using remote computing resources. Specifically, a system can include a mobile device in communication with a hearing assistance device or a remote server. The mobile device can interpret an acoustic environment and send information about the environment to a remote server. The remote server can determine and send information to the mobile device for use in a user interface. The mobile device can receive a user selection of hearing assistance parameter information to be sent to the hearing assistance device.

20 Claims, 6 Drawing Sheets

Related U.S. Application Data continuation of application No. 15/130,020, filed on Apr. 15, 2016, now Pat. No. 10,129,664.

(60) Provisional application No. 62/147,975, filed on Apr. 15, 2015.

(52) U.S. Cl.
CPC ..... *H04R 25/507* (2013.01); *H04R 25/554* (2013.01); *H04R 25/70* (2013.01); *H04R 29/004* (2013.01); *H04R 2225/39* (2013.01); *H04R 2225/41* (2013.01); *H04R 2225/55* (2013.01); *H04R 2460/07* (2013.01)

(58) Field of Classification Search
CPC ..... H04R 29/004; H04R 2225/39; H04R 2225/41; H04R 2225/55; H04R 2460/07; G10L 25/84
See application file for complete search history.

(56) References Cited

U.S. PATENT DOCUMENTS

| | | | | |
|---|---|---|---|---|
| 6,910,013 | B2 * | 6/2005 | Allegro ..... | H04R 25/407 381/312 |
| 6,978,155 | B2 | 12/2005 | Berg | |
| 7,283,842 | B2 | 10/2007 | Berg | |
| 7,715,576 | B2 | 5/2010 | Ribic | |
| 7,742,612 | B2 * | 6/2010 | Frohlich ..... | H04R 25/507 381/314 |
| 8,718,288 | B2 | 5/2014 | Woods et al. | |
| 9,883,297 | B2 | 1/2018 | Ungstrup et al. | |
| 10,129,664 | B2 | 11/2018 | Fitz et al. | |
| 10,848,881 | B2 | 11/2020 | Fitz et al. | |
| 2014/0314261 | A1 | 10/2014 | Selig et al. | |
| 2019/0149929 | A1 | 5/2019 | Fitz et al. | |

OTHER PUBLICATIONS

"U.S. Appl. No. 15/136,020, Notice of Allowance dated Jul. 11, 2018", 5 pgs.
"U.S. Appl. No. 15/130,020, Response filed Mar. 8, 2018 to Non Final Office Action dated Dec. 8, 2017", 9 pgs.
"U.S. Appl. No. 16/188,264, Non Final Office Action dated Apr. 23, 2020", 8 pgs.
"U.S. Appl. No. 16/188,264, Notice of Allowance dated Jul. 22, 2020", 5 pgs.
"U.S. Appl. No. 16/188,264, Preliminary Amendment filed Feb. 4, 2019", 6 pgs.
"U.S. Appl. No. 16/188,264, Response filed Jul. 13, 2020 to Non Final Office Action dated Apr. 23, 2020", 7 pgs.
"European Application No. 16165683.0, Communication Pursuant to Article 94(3) EPC dated Nov. 27, 2017", 4 pgs.
"European Application Serial No. 16165683.0, Extended European Search Report dated 'Aug. 19, 2016", 9 pgs.
"European Application Serial No. 16165683.0, Response filed Mar. 28, 18 to Communication Pursuant to Article 94(3) EPC dated Nov. 27, 2017", 48 pgs.
U.S. Appl. No. 15/130,020 U.S. Pat. No. 10,129,664, filed Apr. 15, 2016, User Adjustment Interface Using Remote Computing Resource.
U.S. Appl. No. 16/188,264 U.S. Pat. No. 10,848,881, filed Nov. 12, 2018, User Adjustment Interface Using Remote Computing Resource.

* cited by examiner

USER ADJUSTMENT INTERFACE USING REMOTE COMPUTING RESOURCE

CLAIM OF PRIORITY

This patent application is a continuation of U.S. patent application Ser. No. 16/188,264, filed Nov. 12, 2018, now issued as U.S. Pat. No. 10,848,881, which is a continuation of U.S. patent application Ser. No. 15/130,020, filed Apr. 15, 2016, now issued as U.S. Pat. No. 10,129,664, which claims the benefit of priority of U.S. Provisional Patent Application Ser. No. 62/147,975, entitled "Automatic Hearing Aid Adjustment Using Remote Acoustic Scan Analysis and Machine Learning," filed on Apr. 15, 2015, each of which are hereby incorporated by reference herein in their entirety.

FIELD OF THE INVENTION

The present subject matter relates to the hearing assistance device user interface for processing and control, and in particular using additional computing resources for analysis.

BACKGROUND

Hearing devices provide sound for the wearer. Examples of hearing devices include headsets, hearing assistance devices, speakers, cochlear implants, bone conduction devices, and personal listening devices. Hearing assistance devices provide amplification to compensate for hearing loss by transmitting amplified sounds to their ear canals. In various examples, a hearing assistance devices is worn in or around a patient's ear.

Hearing assistance devices often have limited processing power, memory, and other computing resources. Due to these limited resources, hearing assistance devices sometimes lack the ability to directly implement resource-intensive operations. Hearing assistance devices typically include digital electronics to enhance the wearer's experience. This enhanced functionality is further benefited from communications, such as from a mobile device or a remote source for advanced processing.

SUMMARY

Disclosed herein, among other things, are systems and methods for remote analysis of an acoustic environment to be used in a hearing assistance device. Specifically, a system can include a hearing assistance device, a mobile device, and a remote server. The mobile device can capture an acoustic environmental and send information about the environment to a remote server. The remote server can search for similar acoustic feature sets and associated hearing assistance parameters. The hearing assistance parameters can be sent to the mobile device for selection by a user or parameters can be sent to the hearing assistance device (e.g., via the mobile device).

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
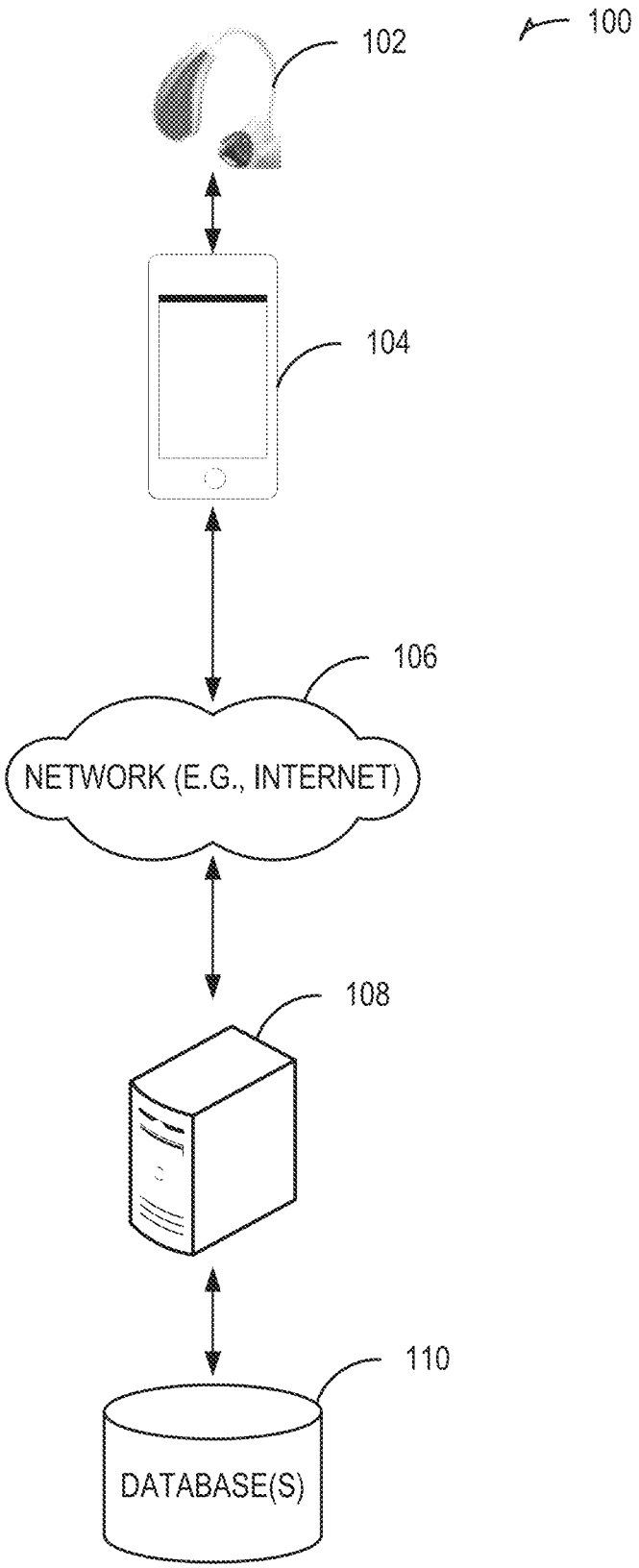
FIG. 1 illustrates a system for augmenting the acoustic processing of a hearing assistance device according to an example.

The following detailed description of the present subject matter refers to subject matter in the accompanying drawings which show, by way of illustration, specific aspects and embodiments in which the present subject matter can be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

In an example, an acoustic environment analysis can be conducted. The analysis can be conducted in order to provide different acoustic environment processing in different environments, for example, based on user preference, user comfort with changes in processing in different environments, or in order to provide processing that is useful in some specific environments but can be detrimental in other environments. For example, in systems that can determine that a user of a hearing assistance device is sitting in a church or an opera, the systems can provide a user interface for adjusting the hearing assistance device. Adjustments to parameters of the hearing assistance device can be made by the user of the hearing assistance device (so-called self-adjusting, as opposed to adjustments made by an audiologist or fitting professional) using the user interface. The user interface can be specific to the listening environment (e.g., church, opera, etc.).

Hearings assistance devices are able to perform only limited acoustic environment analysis due to processing and memory constraints. Additional computing resources such as mobile devices and cloud computing can greatly expand the possibilities for improving environment classification and adaptation, and subsequent hearing aid adjustment. In an example, improving classification and adaptation can include aspects beyond the acoustic environment, such as adaptation to a listening situation identified non-acoustically. For example, in systems that can determine from non-acoustic information, such as global positioning system (GPS) data or accelerometer data, that a user of a hearing assistance device is traveling in a car or airplane, the systems can provide a user interface for adjusting the hearing assistance device. The user interface can be specific to the situation (e.g., car, airplane, etc.). In an example, the non-acoustic identification can include data related to the user of the hearing assistance device (e.g., audiometric thresholds) or about the state of the user (e.g., bio-sensor data, such as galvanic skin response data). Acoustic data can be combined or used in conjunction with non-acoustic data.

Machine learning techniques, represent one class of algorithms that operate either on the mobile device, or on a computing server in the cloud, or both, to respond to data provided from the user's mobile device (or hearing aids).

In addition, combining, in some fashion, data collected from a large number of users is one potential way that the server in the cloud can add capability that is unavailable with the mobile device alone. Machine learning algorithms are useful tools for (among other things) processing and learning from very large volumes of data.

In an example, using computing resources remote to the hearing assistance device can improve hearing assistance device adjustments by performing an acoustic scene analysis on the remote computing resources. Remote computing resources can be provided by a mobile device, or some other wirelessly connected device in the vicinity of the user, or by a computer or server in the cloud, connected to the user's mobile device by a network. The remote computing resources can have significantly greater processing power than the hearing assistance device, and can use computationally demanding data analysis algorithms, and can incorporate additional data not available locally. In an example, additional data can be drawn from a history of the user's activities and interactions, or from a history of many users' activities and interactions.

Remote computing resources can provide hearing assistance device users a better performing hearing assistance device by using acoustic scene analysis to configure a graphical interface for self-adjusting. In an example, the remote computing resources can expand or replace the self-adjusting (adjustments made by a wearer of a hearing assistance device) done in the hearing assistance device, using a graphical interface operating on the mobile device. In an example, a hearing assistance device system with computing resources remote to the hearing assistance device can adapt and improve by learning over time using a growing database.

FIG. 1 illustrates a system 100 for augmenting the acoustic processing of a hearing assistance device according to an example. The system 100 can include a hearing assistance device 102, in communication with a mobile device 104. The mobile device 104 can access a network 106, such as the internet or a local area network, to connect with a remote device, such as a tablet, laptop, desktop computer, or a server 108. In alternative embodiments, the hearing assistance device 102 can communicate directly with the tablet, laptop, desktop computer, or the server 108. These devices can be accessed in any order with any device being the terminal remote device to process the acoustic environment captured by the hearing assistance device 102 or an intermediary device. The mobile device 104 can, in an alternative, process the acoustic environment without sending information to an additional device.

In another example, the mobile device 104 can be used to send acoustic environment information to the server 108, via the network 106, and the server 108 can process the acoustic environment information and send parameters back to the mobile device 104 for implementation by the hearing assistance device 102.

The mobile device 104 or the server 108 can save previously selected parameters for a user. The mobile device 104 can include an internal microphone, an external microphone, or can connect to a microphone remotely. The hearing assistance device 102 can capture the acoustic environment and send information about the acoustic environment to the mobile device 104, such as by using a wireless connection.

In an example, a database 110 can be accessed by any of the devices including the mobile device 104. In another example, the server 108 can include the database 110. The database 110 can include one or more databases on one or more servers or computers. In an example, acoustic analysis data (e.g., measurements or features), can come from a single user, or from many users, or the data can include information distilled from multiple submitted sets of acoustic analysis data (e.g., measurements or features), non-acoustic data, or both. In addition, the data can contain hearing assistance parameters or user interface configuration information associated with the acoustic environments or features.

A machine learning system, such as an artificial neural network, can be used to implement or support the learning from aggregated data, for example from a plurality of users, or in another example, from a single user. As the database grows, the neural network can be retrained (or further trained) to improve its accuracy, and the quality of the returned results. The neural network training can be performed on the server 108, or it can be performed on the mobile device 104, including with additional optional data (e.g., data from multiple users) supplied from the server 108. The online operation of the neural network can be performed on the server 108 or on the mobile device 104, or on the hearing assistance device 102. The neural network can also be trained and downloaded from the server 108.

Neural networks are used to learn automatically the relationship between data available in the online operation and a desired system response or output. In this case, the network learns (during the training phase) the relationship between input data (for example, acoustic features) and desired outputs (for example, a configuration of the self-adjustment UI).

Neural network-based processing generalizes and infers the optimal relationship between input data and desired output from a large number of examples, referred to as a training set. Elements of the training set comprise an example of network input and the desired target network output. During the training process, which can be performed offline, the network configuration is adapted gradually to optimize its ability to correctly predict the target output for each input in the training set. Given the training set, the network learns to extract the salient features from the input data, those that best predict the desired output, and to optimally and efficiently combine those features to produce the desired output from the input. During a training phase, example system inputs are provided to the algorithm along with corresponding desired outputs, and over many such input-output pairs, the learning algorithms adapt their internal states to improve their ability to predict the output that should be produced for a given input. For a well-chosen training set, the algorithm will learn to predict outputs for inputs that are not part of the training set. This contrasts with traditional signal processing methods, in which an algorithm designer has to know and specify a priori the relationship between input features and desired outputs. Most of the computational burden in machine learning algorithms (of which neural networks are an example) is loaded on the training phase. The process of adapting the internal state of a neural network from individual training examples is not costly, but for effective learning, very large training sets are required. In various embodiments, learning takes place during an offline training phase, which is done in product development or research, but not in the field.

In certain embodiments, the neural network training, or some part of it, can be performed online. For example, based on data collected from the hearing aid wearer's experience, the neural network can be retrained (or refined through additional training) on a smart phone, which can then download the updated network weights and/or configuration to the hearing aid. Based on data collected from a group of hearing aid wearers' experiences, such as collected on a server in the cloud, the neural network can be retrained in the cloud, connected through the mobile device, which can then download the updated network weights and/or configuration to the hearing aid in further embodiments. In further embodiments, the neural network is retrained in the cloud and the updated network weights or configuration are applied in the mobile device.

Data used to train the neural network can come from adjustments made by hearing assistance device wearers, using a User Interface (UI), or using some other mechanism (such as volume control), or they can come from other information solicited from the hearing assistance device wearer, or from other non-interactive components (including, for example, geolocation information obtained from the mobile device, or navigation data). Data can be acoustic or non-acoustic. The non-acoustic data can represent an acoustic environment, or can represent characteristics of a hearing assistance device wearer (such as a user's audiogram, or data from a biosensor or biosensors).

The results produced by the network can be used to configure a UI, (as described above), or to present some other adjustment mechanism to the hearing assistance device user, or to control or configure the hearing assistance device directly through the mobile device. A hearing assistance device as described herein can include a pair of hearing assistance devices, a set of hearing assistance devices, etc., or an individual hearing assistance device. In cases of multiple hearing assistance devices, parameters can be determined for each hearing assistance device individually, pairs or sets of hearing assistance devices, or all of the multiple hearing assistance devices at once. In various embodiments, other supervised machine learning algorithms can be employed in place of neural networks.

The systems and methods described herein can provide a situation-specific self-adjustment tool on a mobile device, and use remote computing resources (e.g., on the mobile device or in the cloud/at a server) to determine how that tool should change according to an acoustic environment or listening situation. In an example using a server, data from multiple users can be used by the system to learn over time, through use, how to recommend or provide a self-adjustment tool appropriate to the user's immediate listening environment or listening situation. The systems and methods described herein can greatly reduce time required to adjust the hearing assistance device for a user in response to changing listening environments. The systems and methods can eliminate the need of the user to return to a hearing professional for adjustments which increases the likelihood of hearing assistance devices being accepted and used.

Figure 2:
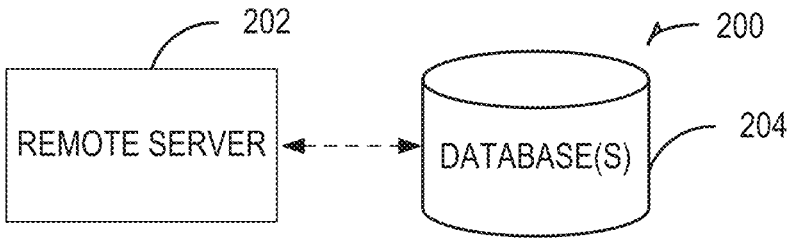
FIG. 2 illustrates a server and storage system for adjusting hearing assistance parameter information according to an example.

FIG. 2 illustrates a remote server 202 and storage (e.g., database(s) 204) system 200 for adjusting hearing assistance parameter information according to an example. The remote server 202 can be communicably coupled to a database(s) 204 for saving hearing assistance parameters. The remote server 202 can run operations to determine a set of hearing assistance parameters from an acoustic feature vector. The set of hearing assistance parameters can be specific to a corresponding hearing assistance device or can be generic to any hearing assistance device. The set of hearing assistance parameters can be determined using a machine learning technique. The machine learning technique can include receiving feedback for a selected hearing assistance parameter from the set of hearing assistance parameters, such as one that is user selected. The remote server 202 can be in communication with a mobile device, such as a mobile phone, tablet, etc. The remote server 202 can store the set of hearing assistance parameters or the user selections in the database(s) 204. The database(s) 204 can be a single storage device, a plurality of storage devices, or can be incorporated in the remote server 202.

Figure 3:
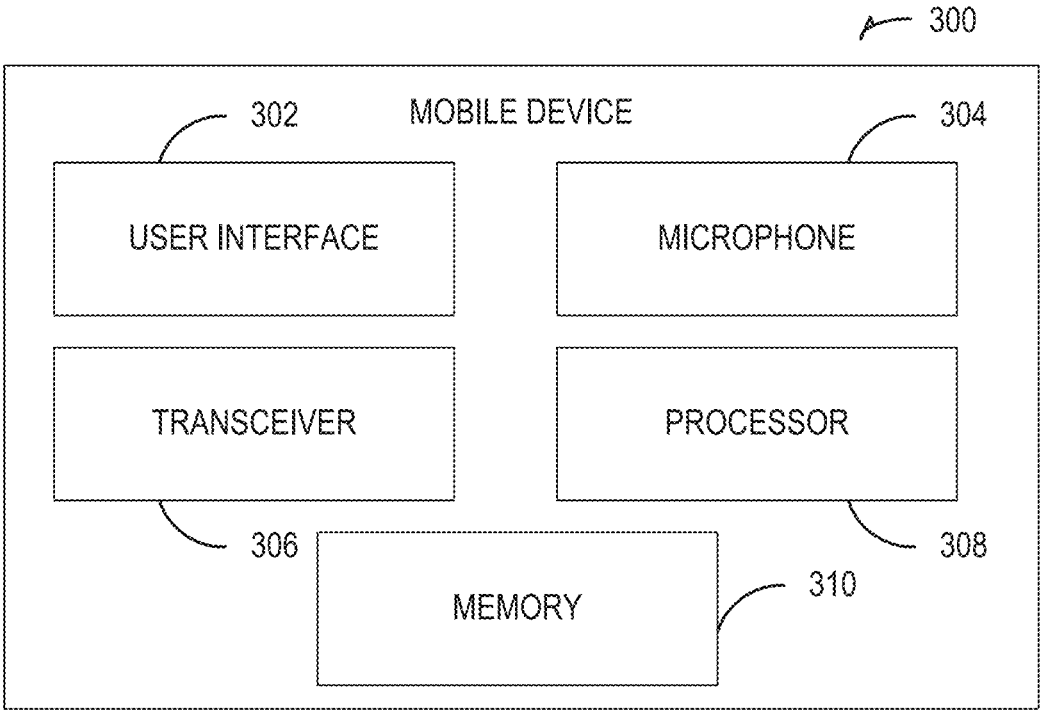
FIG. 3 illustrates a mobile device for adjusting hearing assistance parameter information according to an example.

FIG. 3 illustrates a mobile device 300 for adjusting hearing assistance parameter information according to an example. The mobile device 300 includes a user interface 302, a microphone 304, a transceiver 306, a processor 308, and memory 310. The microphone 304 can be used to receive environmental sound, such as ambient noise, speaking voices, music, etc. The microphone 304 can record the environmental sound, and send the recording to the processor 308. The processor 308 can extract an acoustic feature vector from the environmental sound. The acoustic feature vector can be sent, such as using the transceiver 306 or the processor 308 to a server (e.g., the remote server 202 of FIG. 2). The mobile device 300 can receive a set of hearing assistance parameters from a remote server.

The user interface 302 can be used to display or represent the set of hearing assistance parameters, for example, in a pre-defined space on the user interface 302. The processor 308 can be used to run an app on the mobile device 300. The app can be used to display or represent the set of hearing assistance parameters on the user interface 302, such as in the pre-defined space. The user interface 302 can be used to receive a selection, such as a user selection in the pre-defined space (e.g., a touch input or gesture input), of a hearing assistance parameter of the set of hearing assistance parameters. The user selection can be a user input on the user interface 302 that does not appear to be a selection of the hearing assistance parameter, but instead an intuitive graphical selection of an option that sounds the best to the user. The selection can include a selection of a hearing assistance parameter from the set of hearing assistance parameters that sounds best to the user. In another example, determining the selection can include interpolating among hearing assistance parameters to obtain a parameter or parameter change.

In an example, the processor 308 can be used to prepare for output, the hearing assistance parameter selected by the user on the user interface 302. In an example, the transceiver 306 can be used to send the selected hearing assistance parameter to a hearing assistance device. The hearing assistance device can be communicatively coupled to the mobile device 300. For example, the transceiver 306 can send the hearing assistance parameter to the hearing assistance device using Bluetooth, Wi-Fi, near field communication, or the like.

Figure 4:
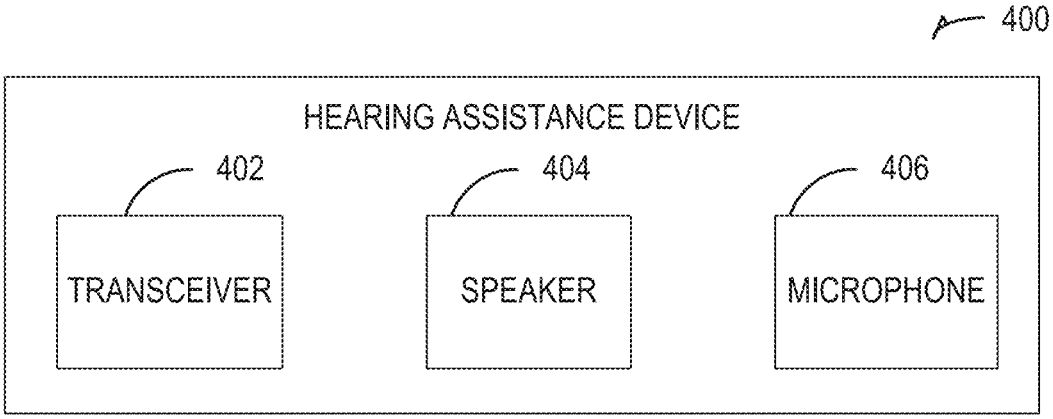
FIG. 4 illustrates a hearing assistance device for receiving hearing assistance parameter adjustments according to an example.

FIG. 4 illustrates a hearing assistance device 400 for receiving hearing assistance parameter adjustments according to an example. The hearing assistance device 400 can include a transceiver 402, a speaker 404, and a microphone 406. The transceiver 402 can be used to receive a hearing assistance parameter selected by a user at a mobile device. The speaker 404 can be used to output ambient sound using the hearing assistance parameter. For example, the hearing assistance parameter can include one or more features, filters, or constraints for outputting sound using the speaker 404.

Figure 5:
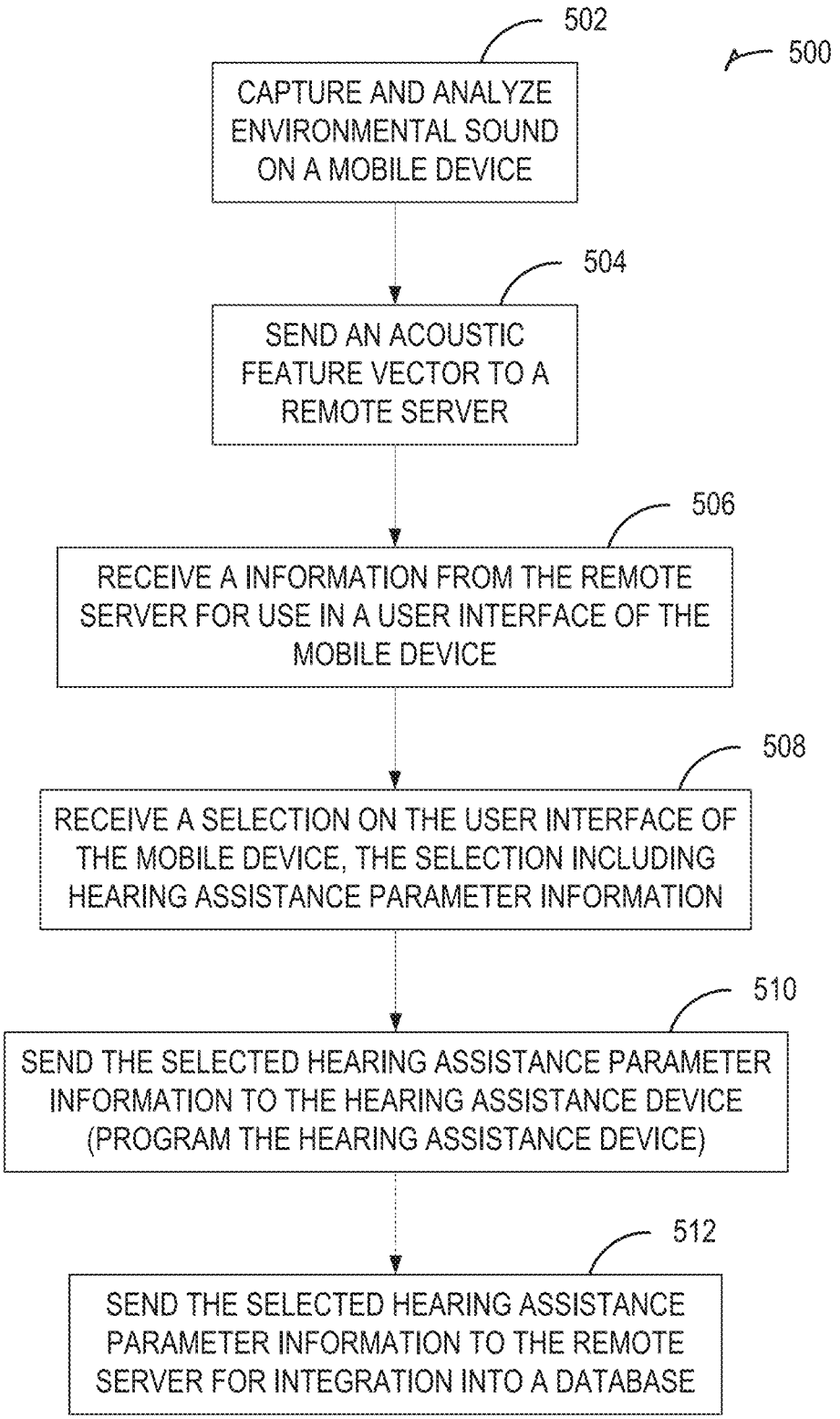
FIG. 5 illustrates a flowchart showing a technique for adjusting hearing assistance parameter information according to an example.

FIG. 5 illustrates a flowchart showing a technique 500 for adjusting hearing assistance parameter information according to an example. The technique 500 includes an operation 502 to capture and analyze environmental sound on a mobile device. Operation 502 can be split into two or more steps to capture and analyze the environmental sound. The environmental sound can be analyzed to determine an acoustic feature vector or a plurality of acoustic feature vectors. The technique 500 includes an operation 504 to send the acoustic feature vector a remote server. The technique 500 includes an operation 506 to receive, from the remote server, information from the remote server for use in a user interface of the mobile device. Operation 506 can include receiving, at the mobile device, visual context coordinates, a set of hearing assistance parameters, changes to hearing assistance parameters, configuration information, or the like, from the remote server.

The technique 500 includes an operation 508 to receive a selection on a user interface of the mobile device, the selection including hearing assistance parameter information. The hearing assistance parameter information can include a parameter or a parameter change. The hearing assistance parameter information can include information from the information for use in the user interface from operation 506. The selection can be made by selecting a visual context coordinate or set of coordinates from the visual context coordinates corresponding to the set of hearing assistance parameters. The technique 500 includes an operation 510 to send the selected hearing assistance parameter information to a hearing assistance device or to program the hearing assistance device with the hearing assistance parameter information. For example, operation 510 can include sending a parameter or a parameter change selected in operation 508 to the hearing assistance device.

The technique 500 can include an optional operation 512 to send the selected hearing assistance parameter information to the remote server for integration into a database. The selection can be used in a machine learning technique to improve selection of future sets of hearing assistance parameters or to improve future hearing assistance parameters themselves.

Figure 6:
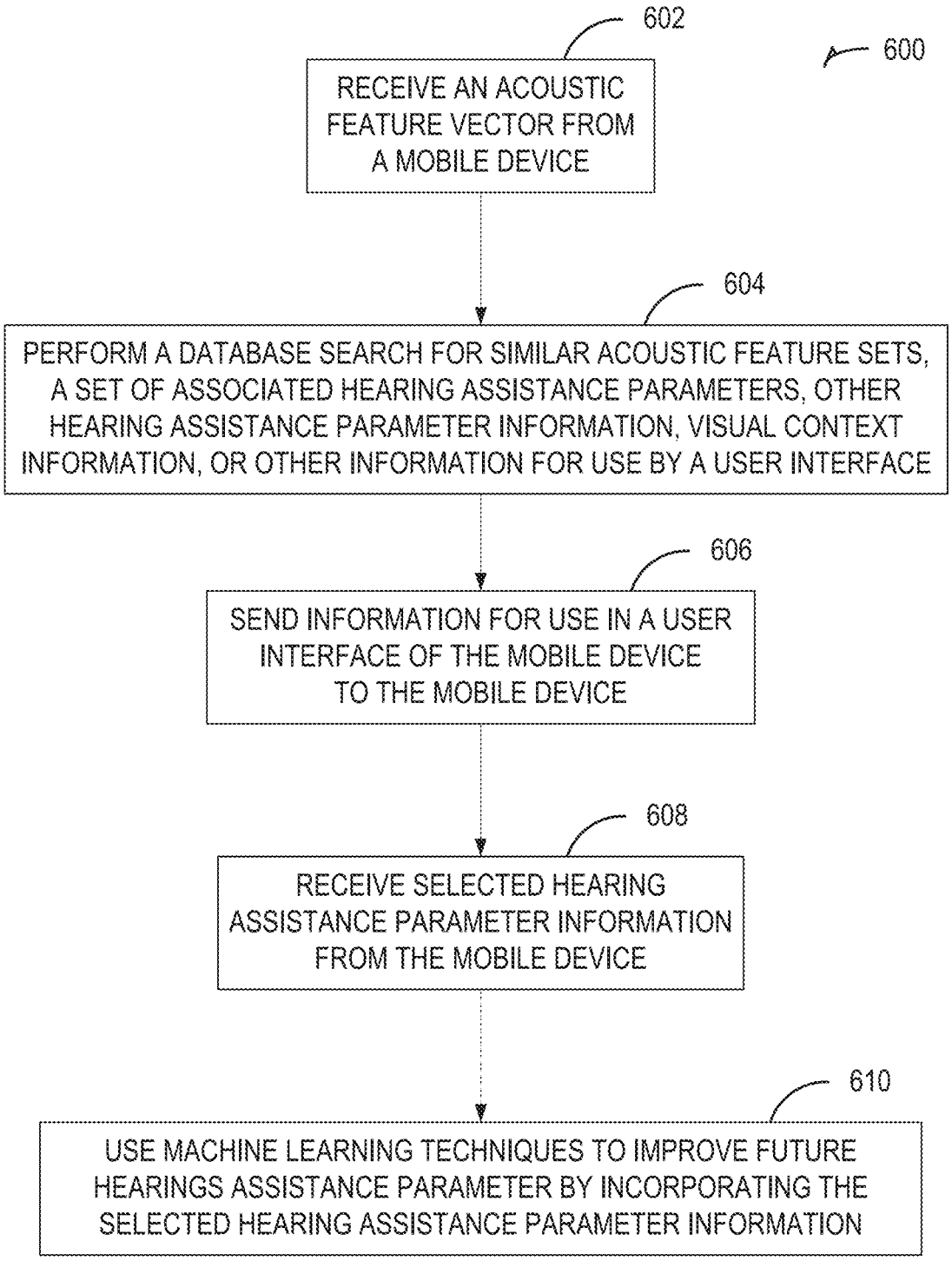
FIG. 6 illustrates a flowchart showing a technique for determining hearing assistance parameters using machine learning techniques according to an example.

FIG. 6 illustrates a flowchart showing a technique 600 for determining hearing assistance parameters using machine learning techniques according to an example. The technique 600 can be done by a remote server. The technique 600 includes an operation 602 to receive an acoustic feature vector from a mobile device. The acoustic feature vector can be determined from environmental sound recorded on the mobile device or a hearing assistance device. The technique 600 includes an operation 604 to perform a database search for similar acoustic feature sets, a set of associated hearing assistance parameters, other hearing assistance parameter information, visual context information, or other information for use by a user interface. The database search can include searching for information applicable to an acoustic feature set. The information can be sent to the mobile device for use in a user interface of the user device. In an example, the search can include a database search for similar acoustic feature sets and a set of associated hearing assistance parameters. The information can be stored in a database from previous selections (e.g., using machine learning techniques), or can be manually associated. In an example the information can be determined directly from the acoustic feature vector, such as when the acoustic feature vector was previously received from the mobile device (or another mobile device or hearing assistance device). In another example, if the acoustic feature vector and a selected hearing assistance parameter was previously received from the mobile device (for example, separately), then the remote server can skip the search of operation 504 and instead send the selected hearing assistance parameter to the mobile device, such as without sending a set of hearing assistance parameters.

The technique 600 includes an operation 606 to send the information for use in a user interface of the mobile device to the mobile device. Operation 606 can include sending visual context coordinates, a set of hearing assistance parameter information, hearing assistance parameter changes, or the like to the mobile device. The technique 600 includes an operation 608 to receive selected hearing assistance parameter information from the mobile device. For example, the selected hearing assistance parameter information can include a parameter, a parameter change, a visual context coordinate or change, a location from the user interface, or the like. The selected hearing assistance parameter information can be from the information sent in operation 606.

The technique 600 can include an optional operation 610 to use machine learning techniques to improve future hearing assistance parameters by incorporating the selection of the selected hearing assistance parameter information, such as into a database. The incorporation can include assigning a weight to the selected hearing assistance parameter information. For example, selections of hearing assistance parameters or changes to the parameters can be given a higher weight than hearing assistance parameters or optional changes that are not selected, less frequently selected, or unselected for a period of time. The machine learning techniques can include techniques to weight hearing assistance parameters or changes, to classify acoustic feature vectors to corresponding hearing assistance parameters or changes, or to determine or assign sets of hearing assistance parameters or changes.

Figure 7:
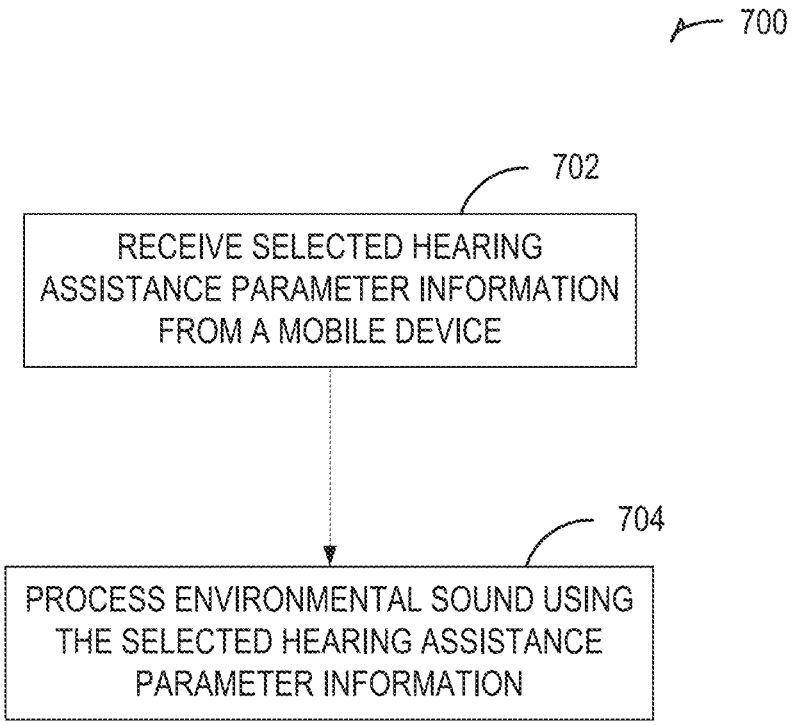
FIG. 7 illustrates a flowchart showing a technique for applying hearing assistance parameters at a hearing assistance device according to an example.

FIG. 7 illustrates a flowchart showing a technique 700 for applying hearing assistance parameters at a hearing assistance device according to an example. The technique can be done by a hearing assistance device. The technique 700 includes an operation 702 to receive selected hearing assistance parameter information from a mobile device. The selected hearing assistance parameter information can include a parameter, a parameter change, or other parameter related information. The technique 700 includes an operation 704 to process environmental sound using the selected hearing assistance parameter information. Operation 704 can apply a selected hearing assistance parameter or parameter change to interpret or output incoming environmental sound or received sound.

Remote analysis of an acoustic environment can be use in a hearing assistance device according to an example. A mobile device, such as a smart phone can include one or more auxiliary microphones connected to the mobile device, built in, connected, or remote to the mobile device (e.g., a built in microphone, a connected or remote computer microphone, a connected or remote watch, a remote hearing assistance device, etc.). In an example, an operation can include using a microphone to sample or record the current acoustic environment and the mobile device or a remote device to analyze acoustic environment in response to user initialization. In another example, the analysis of the sample (e.g., a recording) can be performed on a hearing aid, on a mobile device, or on a remote computer. The mobile device can perform an initial pre-processing, such as a feature extraction. The acoustic environment data (e.g., a sample recording, measurements of a recording, or features of a recording) can be sent to a remote system at another operation. The remote system can include a server, desktop computer, laptop computer, tablet, other mobile device, etc.

An operation can include performing further processing, such as feature extraction or environment classification at the remote system. In an example, the environment classification can incorporate machine learning techniques to determine an optimal set of potential hearing assistance device settings for the user. In another example, the environment classification can incorporate machine learning techniques to determine the configuration of a user interface for self-adjustment of the hearing assistance device settings. The parameters can be returned the to the mobile device. An updated set of constraints or a configuration for a graphical interface can be sent to the mobile device for use on the mobile device, that allows the user to navigate in a predefined space to actively modify the hearing assistance device settings as the user moves around the screen. In another example, a user interface can receive a user input to actively modify the hearing assistance device settings. When the user is comfortable with the hearing assistance device performance, the user can save preferred settings as a new hearing assistance device memory to be accessed easily. The navigated settings chosen by the user can be sent back to the server for integration and learning.

Figure 8:
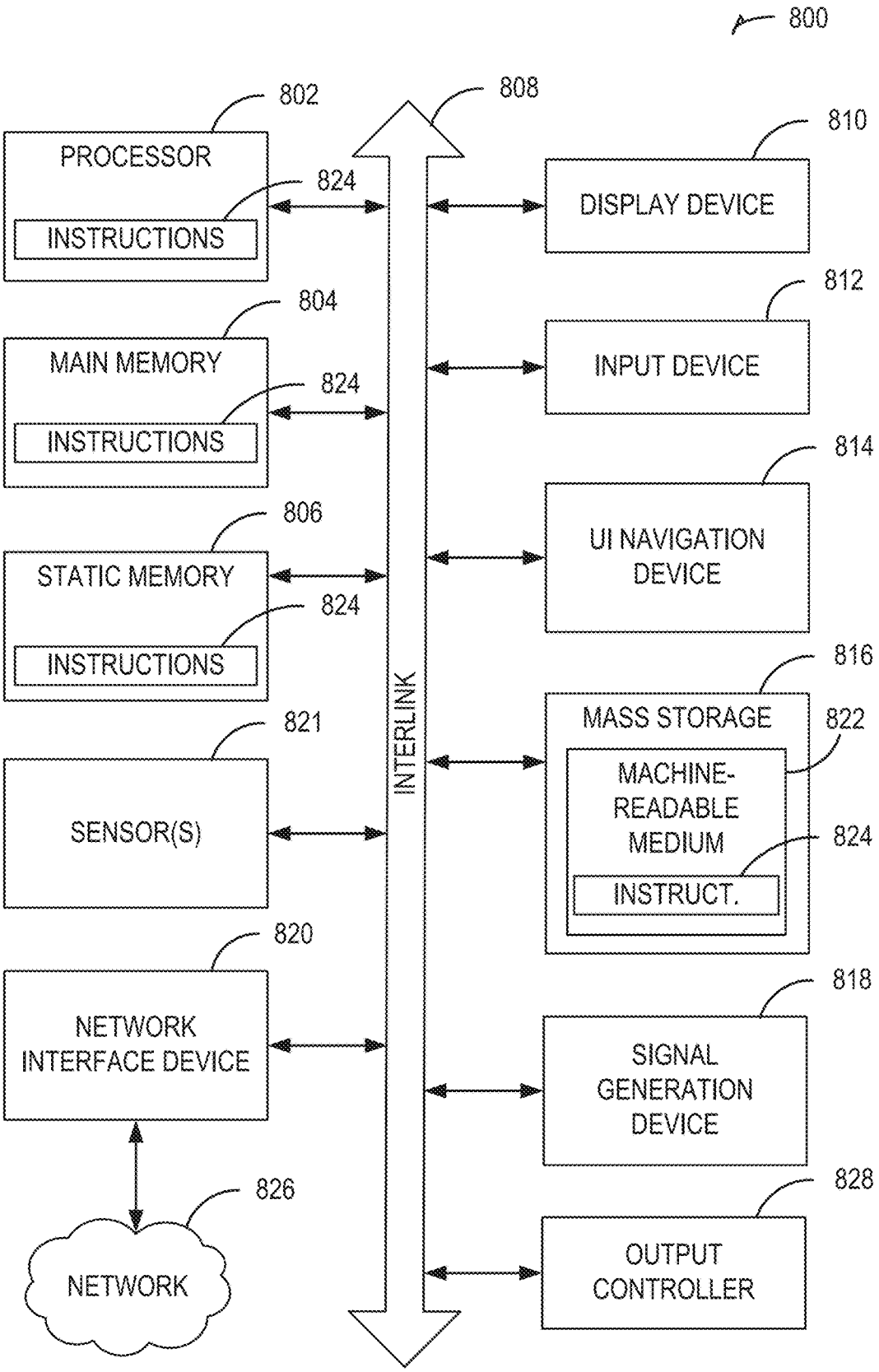
FIG. 8 illustrates generally an example of a block diagram of a machine upon which any one or more of the techniques discussed herein can perform according to an example.

FIG. 8 illustrates generally an example of a block diagram of a machine 800 upon which any one or more of the techniques (e.g., methodologies) discussed herein can perform according to an example. In alternative embodiments, the machine 800 can operate as a standalone device or can be connected (e.g., networked) to other machines. In a networked deployment, the machine 800 can operate in the capacity of a server machine, a client machine, or both in server-client network environments. In an example, the machine 800 can act as a peer machine in peer-to-peer (P2P) (or other distributed) network environment. The machine 800 can be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, can include, or can operate on, logic or a number of components, modules, or mechanisms. Modules are tangible entities (e.g., hardware) capable of performing specified operations when operating. A module includes hardware. In an example, the hardware can be specifically configured to carry out a specific operation (e.g., hardwired). In an example, the hardware can include configurable execution units (e.g., transistors, circuits, etc.) and a computer readable medium containing instructions, where the instructions configure the execution units to carry out a specific operation when in operation. The configuring can occur under the direction of the executions units or a loading mechanism. Accordingly, the execution units are communicatively coupled to the computer readable medium when the device is operating. In this example, the execution units can be a member of more than one module. For example, under operation, the execution units can be configured by a first set of instructions to implement a first module at one point in time and reconfigured by a second set of instructions to implement a second module.

Machine (e.g., computer system) 800 can include a hardware processor 802 (e.g., a central processing unit (CPU), a graphics processing unit (GPU), a hardware processor core, or any combination thereof), a main memory 804 and a static memory 806, some or all of which can communicate with each other via an interlink (e.g., bus) 808. The machine 800 can further include a display unit 810, an alphanumeric input device 812 (e.g., a keyboard), and a user interface (UI) navigation device 814 (e.g., a mouse). In an example, the display unit 810, alphanumeric input device 812 and UI navigation device 814 can be a touch screen display. The machine 800 can additionally include a storage device (e.g., drive unit) 816, a signal generation device 818 (e.g., a speaker), a network interface device 820, and one or more sensors 821, such as a global positioning system (GPS) sensor, compass, accelerometer, or other sensor. The machine 800 can include an output controller 828, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 816 can include a machine readable medium 822 that is non-transitory on which is stored one or more sets of data structures or instructions 824 (e.g., software) embodying or utilized by any one or more of the techniques or functions described herein. The instructions 824 can also reside, completely or at least partially, within the main memory 804, within static memory 806, or within the hardware processor 802 during execution thereof by the machine 800. In an example, one or any combination of the hardware processor 802, the main memory 804, the static memory 806, or the storage device 816 can constitute machine readable media.

While the machine readable medium 822 is illustrated as a single medium, the term "machine readable medium" can include a single medium or multiple media (e.g., a centralized or distributed database, and/or associated caches and servers) configured to store the one or more instructions 824.

The term "machine readable medium" can include any medium that is capable of storing, encoding, or carrying instructions for execution by the machine 800 and that cause the machine 800 to perform any one or more of the techniques of the present disclosure, or that is capable of storing, encoding or carrying data structures used by or associated with such instructions. Non-limiting machine readable medium examples can include solid-state memories, and optical and magnetic media. Specific examples of machine readable media can include: nonvolatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 824 can further be transmitted or received over a communications network 826 using a transmission medium via the network interface device 820 utilizing any one of a number of transfer protocols (e.g., frame relay, internet protocol (IP), transmission control protocol (TCP), user datagram protocol (UDP), hypertext transfer protocol (HTTP), etc.). Example communication networks can include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 820 can include one or more physical jacks (e.g., Ethernet, coaxial, or phone jacks) or one or more antennas to connect to the communications network 826. In an example, the network interface device 820 can include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 800, and includes digital or analog communications signals or other intangible medium to facilitate communication of such software.

Hearing assistance devices typically include at least one enclosure or housing, a microphone, hearing assistance device electronics including processing electronics, and a speaker or "receiver." Hearing assistance devices can include a power source, such as a battery. In various embodiments, the battery can be rechargeable. In various embodiments multiple energy sources can be employed. It is understood that in various embodiments the microphone is optional. It is understood that in various embodiments the receiver is optional. It is understood that variations in communications protocols, antenna configurations, and combinations of components can be employed without departing from the scope of the present subject matter. Antenna configurations can vary and can be included within an enclosure for the electronics or be external to an enclosure for the electronics. Thus, the examples set forth herein are intended to be demonstrative and not a limiting or exhaustive depiction of variations.

It is understood that digital hearing assistance devices include a processor. In digital hearing assistance devices with a processor, programmable gains can be employed to adjust the hearing assistance device output to a wearer's particular hearing impairment. The processor can be a digital signal processor (DSP), microprocessor, microcontroller, other digital logic, or combinations thereof. The processing can be done by a single processor, or can be distributed over different devices. The processing of signals referenced in this application can be performed using the processor or over different devices. Processing can be done in the digital domain, the analog domain, or combinations thereof. Processing can be done using subband processing techniques. Processing can be done using frequency domain or time domain approaches. Some processing can involve both frequency and time domain aspects. For brevity, in some examples drawings can omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which can or can not be explicitly shown. Various types of memory can be used, including volatile and nonvolatile forms of memory. In various embodiments, the processor or other processing devices execute instructions to perform a number of signal processing tasks. Such embodiments can include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing assistance device. In various embodiments the wireless communications can include standard or nonstandard communications. Some examples of standard wireless communications include, but not limited to, Bluetooth™, low energy Bluetooth, IEEE 802.11 (wireless LANs), 802.15 (WPANs), and 802.16 (WiMAX). Cellular communications can include, but not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system can be demonstrated as radio communication systems, it is possible that other forms of wireless communications can be used. It is understood that past and present standards can be used. It is also contemplated that future versions of these standards and new future standards can be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols can be employed without departing from the scope of the present subject matter.

In various embodiments, the present subject matter is used in hearing assistance devices that are configured to communicate with mobile phones. In such embodiments, the hearing assistance device can be operable to perform one or more of the following: answer incoming calls, hang up on calls, and/or provide two way telephone communications. In various embodiments, the present subject matter is used in hearing assistance devices configured to communicate with packet-based devices. In various embodiments, the present subject matter includes hearing assistance devices configured to communicate with streaming audio devices. In various embodiments, the present subject matter includes hearing assistance devices configured to communicate with Wi-Fi devices. In various embodiments, the present subject matter includes hearing assistance devices capable of being controlled by remote control devices.

It is further understood that different hearing assistance devices can embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter can be employed in hearing assistance devices, such as headsets, headphones, and similar hearing devices.

The present subject matter is demonstrated for hearing assistance devices, including hearing assistance devices, including but not limited to, behind-the-ear (BTE), in-the-ear (ITE), in-the-canal (ITC), receiver-in-canal (RIC), or completely-in-the-canal (CIC) type hearing assistance devices. It is understood that behind-the-ear type hearing assistance devices can include devices that reside substantially behind the ear or over the ear. Such devices can include hearing assistance devices with receivers associated with the electronics portion of the behind-the-ear device, or hearing assistance devices of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard fitted, open fitted and/or occlusive fitted. It is understood that other hearing assistance devices not expressly stated herein can be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for adjusting hearing assistance parameters for use in a hearing assistance device, the method comprising:

receiving, at a server, structured acoustic information via a mobile device, the structured acoustic information generated by the mobile device based on environmental sound recorded at the hearing assistance device;

automatically classifying, using a processor of the server, the structured acoustic information using a machine learning trained classifier, the machine learning trained classifier identifying a hearing assistance parameter associated with the structured acoustic information; and outputting the hearing assistance parameter information corresponding to the classification to the mobile device, the information configured to be sent by the mobile device to the hearing assistance device to adjust the hearing assistance parameters of the hearing assistance device.

2. The method of claim 1, wherein the machine learning trained classifier includes a neural network trained using non-interactive component data.

3. The method of claim 2, wherein the non-interactive component data includes geolocation information obtained from the mobile device.

4. The method of claim 1, wherein the structured acoustic information describes environmental sound received at a microphone of the mobile device.

5. The method of claim 1, wherein outputting the information includes outputting hearing assistance parameter changes.

6. The method of claim 1, further comprising receiving the structured acoustic information from the mobile device based on a user selection.

7. The method of claim 1, wherein the hearing assistance parameter information includes a parameter, a parameter change, a visual context coordinate or change, or a location on a user interface.

8. The method of claim 1, further comprising incorporating the hearing assistance parameter information in retraining the machine learning trained classifier to improve future hearing assistance parameters.

9. The method of claim 8, wherein incorporating the hearing assistance parameter information includes assigning weights to the hearing assistance parameter information, including a higher weight for the hearing assistance parameter information than for unselected hearing assistance parameters.

10. The method of claim 1, wherein the structured acoustic information includes an acoustic feature vector representing environmental sound captured at the mobile device.

11. A method for adjusting hearing assistance parameters for use in a hearing assistance device, the method comprising:

receiving, at a server, structured acoustic information from the hearing assistance device via communication with a mobile device, the structured acoustic information generated by the mobile device based on environmental sound recorded at the hearing assistance device;

automatically classifying, using a processor of the server, the structured acoustic information using a machine learning trained classifier, the machine learning trained classifier identifying a hearing assistance parameter associated with the structured acoustic information; and outputting the hearing assistance parameter information corresponding to the classification to the hearing assistance device to adjust the hearing assistance parameters via communication with the mobile device.

12. The method of claim 11, wherein the machine learning trained classifier includes a neural network trained using non-interactive component data.

13. The method of claim 12, wherein the non-interactive component data includes geolocation information obtained from the mobile device.

14. The method of claim 11, wherein the structured acoustic information describes environmental sound received at a microphone of the mobile device.

15. The method of claim 11, wherein outputting the information includes outputting hearing assistance parameter changes.

16. The method of claim 11, further comprising receiving structured acoustic information based on a user selection.

17. The method of claim 11, wherein the hearing assistance parameter information includes a parameter, a parameter change, a visual context coordinate or change, or a location on a user interface.

18. The method of claim 11, further comprising incorporating the hearing assistance parameter information in retraining the machine learning trained classifier to improve future hearing assistance parameters.

19. The method of claim 18, wherein incorporating the hearing assistance parameter information includes assigning weights to the hearing assistance parameter information, including a higher weight for the hearing assistance parameter information than for unselected hearing assistance parameters.

20. The method of claim 11, wherein the structured acoustic information includes an acoustic feature vector representing environmental sound captured at the hearing assistance device.

* * * * *